US007228769B2

(12) United States Patent
Mendoza

(10) Patent No.: US 7,228,769 B2
(45) Date of Patent: Jun. 12, 2007

(54) BOTTLE OPENER AND STORAGE DEVICE

(75) Inventor: Todd Mendoza, Dublin, OH (US)

(73) Assignee: Todd M. Mendoza, Dublin, OH (US)

( * ) Notice: Subject to any disclaimer, the term of this patent is extended or adjusted under 35 U.S.C. 154(b) by 84 days.

(21) Appl. No.: 11/148,518

(22) Filed: Jun. 9, 2005

(65) Prior Publication Data

US 2006/0278541 A1 Dec. 14, 2006

(51) Int. Cl.

| | |
|---|---|
| ***B25B 7/14*** | (2006.01) |
| *B67B 7/14* | (2006.01) |
| *B65D 75/00* | (2006.01) |
| *B65D 23/06* | (2006.01) |

(52) U.S. Cl. ..... 81/315; 81/3.44; 81/3.42; 206/141; 215/41

(58) Field of Classification Search ..... 81/315, 81/3.44, 3.42, 3.34; 206/141, 61; 215/41
See application file for complete search history.

(56) References Cited

U.S. PATENT DOCUMENTS

| | | | | |
|---|---|---|---|---|
| 1,913,535 | A * | 6/1933 | Cressey | 81/3.44 |
| 3,542,231 | A * | 11/1970 | Wettermann et al. | 215/226 |
| 4,523,497 | A * | 6/1985 | Rosberg et al. | 81/3.44 |
| 5,718,330 | A * | 2/1998 | Auffret et al. | 206/141 |

* cited by examiner

*Primary Examiner*—Lee D. Wilson
*Assistant Examiner*—Alvin J. Grant
(74) *Attorney, Agent, or Firm*—Stanley Law Group LL

(57) ABSTRACT

The present invention relates generally to openers and storage devices for bottled beverages. More particularly, the apparatus and method of the present invention relates to a device designed such that it may hold at least one bottle for storing and be used to easily remove bottle caps.

20 Claims, 4 Drawing Sheets

BOTTLE OPENER AND STORAGE DEVICE

BACKGROUND AND SUMMARY OF THE INVENTION

The present invention relates generally to bottle openers and bottle storage devices. More particularly, the apparatus and method of the present invention relates to a device designed such that it may hold at least one bottle for storing and be used to easily remove bottle caps.

Bottle cap removers are known in the art. Typically, they are a hand held device that makes contact with the cap under its edge and along the caps top to pry the cap off the bottle. Another type of commonly used cap remover is one that is attached to a wall or side of a bar, instead of being handheld, wherein the user places the bottle cap end into the remover and then pries the cap off the bottle by moving the bottle. These known cap removers are limited to removing the cap off of one bottle at a time. In addition, they do not hold the bottle for storage and easy removal when the bottled beverage is ready to be served.

For example, an establishment that servers bottled beverages may receive from the supplier bottled beverages in a packaged container of holding multiple bottles of the beverage including, but not limited to, 6, 12, 18, 24, 30, or any other number of bottles. When the employee of the establishment stocks the bottled beverages, the employee grabs one bottle at a time and typically places each one on a shelf or a bottom of a refrigerator or cooler so that it is available for serving in the future. When the employee is stocking large amounts of bottled beverages, this can be a very time consuming task.

In addition, when a customer orders a bottled beverage, the employee must grab a bottle in his/her hand and then open the bottle by using either a handheld opener or by placing the bottle cap end in a remover and opening the bottle. This task seems simple enough. However, having to open one bottle at a time can be troubling in a very busy establishment and especially when customers order multiple bottled beverages at a time. There exist a need for a device that improves the ease and speed of stocking and storing bottled beverages as well as opening multiple bottled beverages.

The bottle holder and opener of the present invention meets such a need. The bottle holder and opener of the present invention provides an employee an apparatus and method to grip multiple bottles at a time and then place those bottles very quickly in storage for future serving. In addition, the present invention provides an apparatus and method to remove multiple caps from multiple bottles simultaneously in a very easy and quick manner. The present invention provides a body having at least one aperture for receiving the cap of a bottle and a slideable member that engages the cap and enables the bottle to suspend from the cap. The present invention further provides a holder that may engage the body and hold it for storing and future serving of the bottled beverages held by the body.

In addition to the novel features and advantages mentioned above, other features and advantages of the present invention will be readily apparent from the following descriptions of the drawings and exemplary embodiments.

BRIEF DESCRIPTION OF THE DRAWINGS

Novel features and advantages of the present invention, in addition to those mentioned above, will become apparent to those skilled in the art from a reading of the following detailed description in conjunction with the accompanying drawings wherein similar reference characters refer to similar parts and in which.

DETAILED DESCRIPTION OF PREFERRED EMBODIMENT(S)

Figure 1:
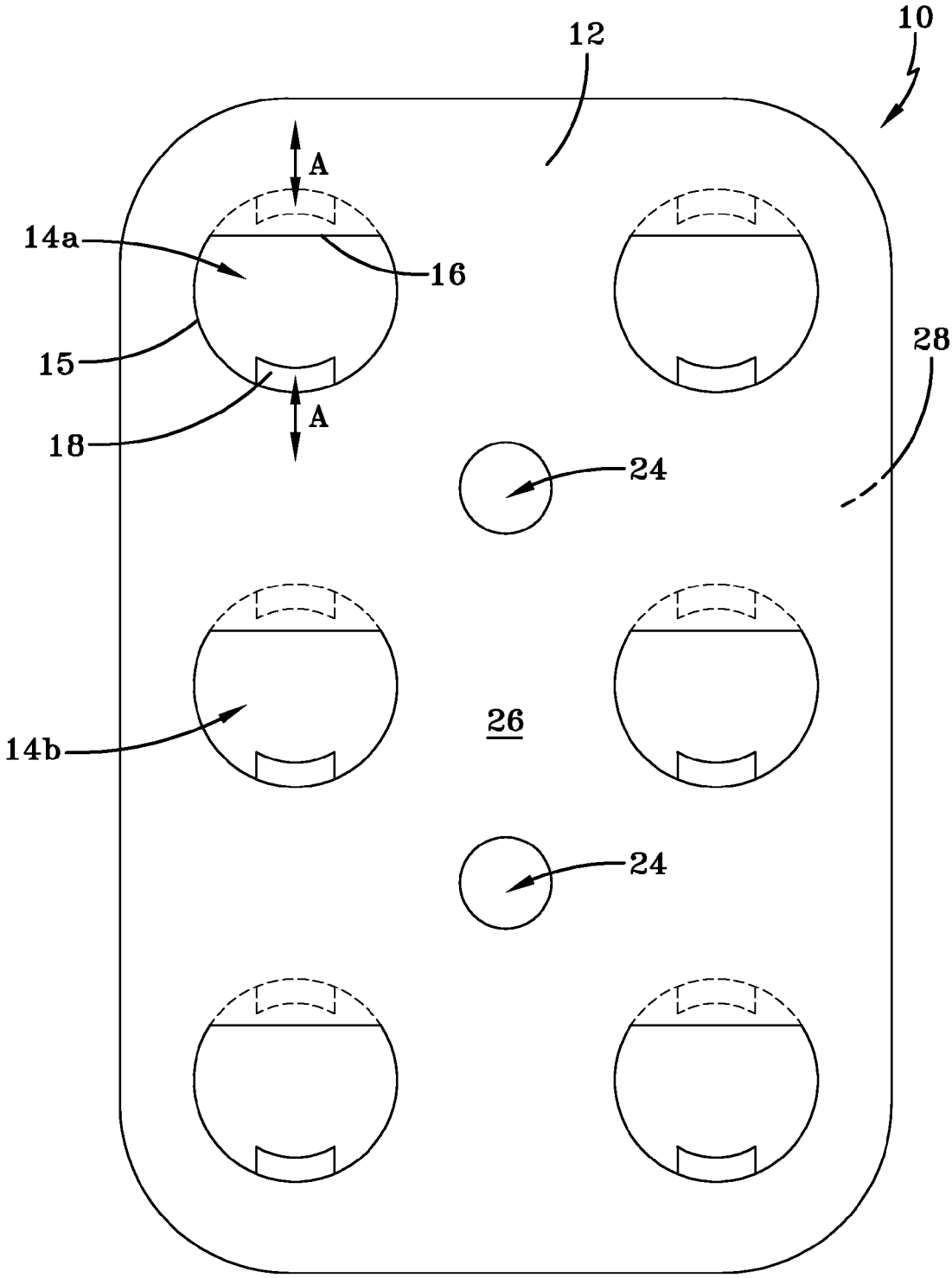
FIG. 1 illustrates a top plan view of one embodiment of a bottle opener of the present invention.

The preferred system herein described is not intended to be exhaustive or to limit the invention to the precise forms disclosed. They are chosen and described to explain the principles of the invention, and the application of the method to practical uses, so that others skilled in the art may practice the invention.

The bottle opener 10 of the present invention comprises a body 12 that includes at least 1 aperture 14 disposed therethrough. The aperture is defined by a perimeter edge 15. The body 12 may include more than one aperture 14. For example, the body 12 may include, but not is limited to, 6, 12, 18, 24, or any other number of apertures to correspond with the same number of bottled beverages contained within a package. The number and shape of the bottle opener 10 and the apertures 14 may vary without departing from the scope of the invention.

The opener 10 may also include a member 18 or multiple members 18 movably affixed to the body 12. In one embodiment, two members 18*a* and 18*b* are positioned substantially opposite from one another along the aperture 14. The members 18 may be positioned such that they are partially protruding passed the perimeter edge 15 and into the aperture 14. This position of the member 18 is considered the member's normal position. This normal position of the member 18 reduces the size of the aperture 14. The member 18 is adapted to slide outwardly away from the normal position, i.e., away from the center of the aperture 14, and inwardly toward the normal position, i.e., toward the center of the aperture 14, along a plane substantially parallel to the body 12 as shown in FIG. 1 by direction arrow A.

The body 12 has a top surface 26 and a bottom surface 28. The body may have stop 16 affixed to the top surface 26. This stop 16 is adapted to prevent the bottle cap end from passing completely through the aperture 14. It also may act as one of the contact points on top of the cap when the opener 10 pries off the cap from the bottle.

The bottle opener 10 may also include a means for providing a spring force 30 to the member(s) 18. The means for providing a spring force 30 maintains the member 18 in the normal position but allows the member 18 to slide outwardly from the normal position if the spring force is overcome by a greater force in the opposite direction. However, once this force is removed, the means for providing a spring force 30 returns the member 18 back to the normal position. It is understood the means for providing a spring force 30 may be any material or mechanical device having a memory such that the means for providing a spring force can be compressed or stretched and then have a sufficient memory to return or spring it back to the normal position.

Referring to FIG. 1, an exemplary embodiment of a bottle opener 10 of the present invention is shown. The bottle opener 10 includes a body 12 having 6 apertures 14 therethrough. The body may have finger holes 24. The apertures' 14 positions correspond with the positions' of bottled beverages within package, in this exemplary embodiment, a "6-pack". The body 12 is partially cut-out in FIG. 2 for illustration purposes. Each aperture 14 optionally includes 2 chambers 20 positioned along the perimeter edge 15 and disposed within the body 12. In this particular embodiment, the chambers 20 are positioned substantially opposite from one another. Each chamber partially contains a portion of member 18 within it. The remaining portion of member 18 is protruding passed the perimeter edge 15 and into aperture 14. This embodiment has two members 18 protruding from chambers 20 into each aperture 14. It is understood that the shape, size, and number of the members 18 may vary without changing the scope of the invention. The chambers may be designed such that they may limit the range of motion of the members 18.

Each member 18 may include an engaging face 17 and an abutting face 19. The engaging face 17 is the face of member 18 that protrudes into aperture 14. The abutting face 19 is the face of member 18 that is contained within chamber 20. As described above, the member 18 is affixed to the body 12 such that the member 18 may slide outwardly away from the normal position and inwardly back to the normal position along a plane substantially parallel to the surface of the body 12 shown by arrow A. In this embodiment, the chamber 20 affixes the member 18 to body 12.

Figure 2:
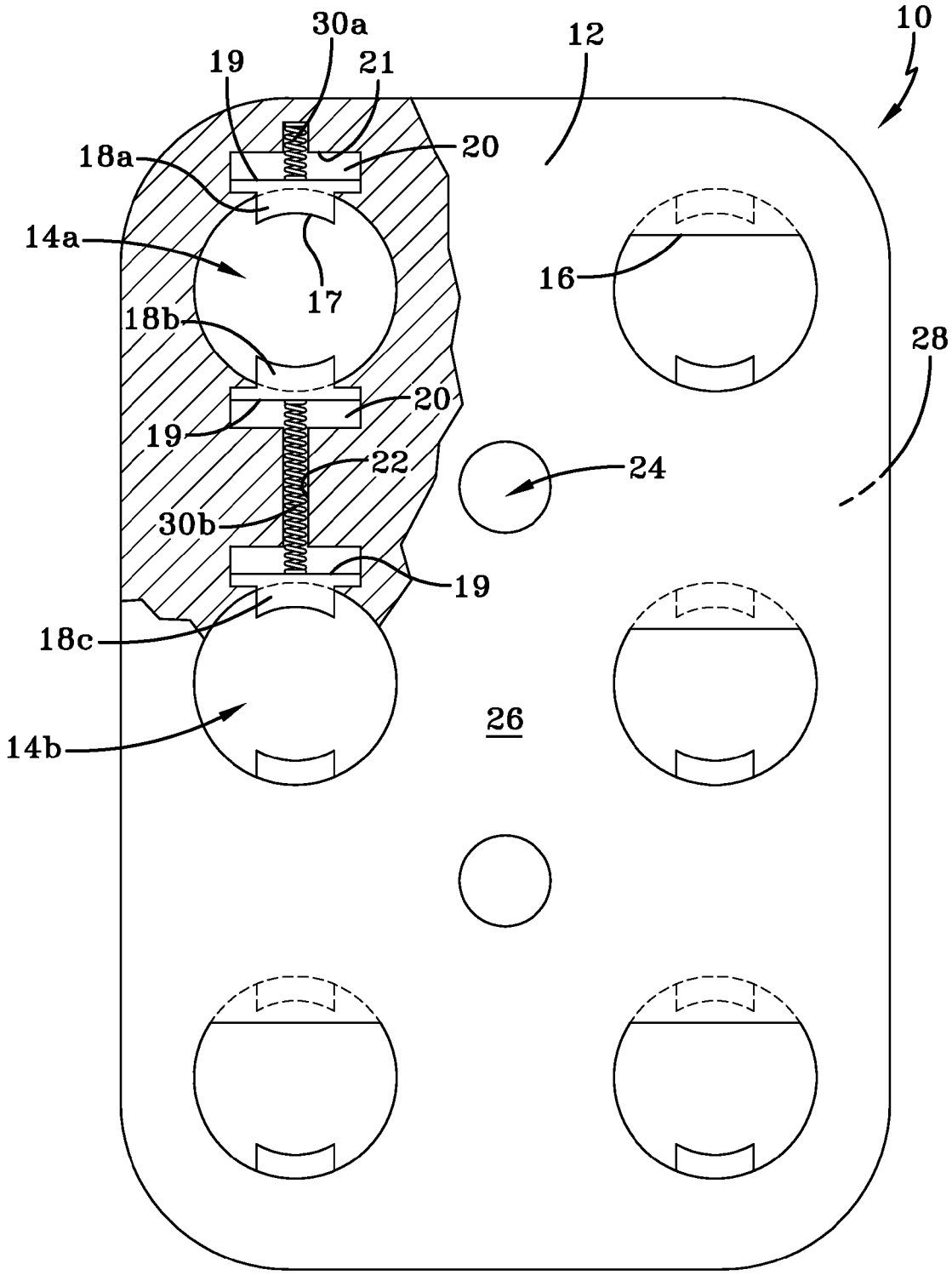
FIG. 2 illustrates a top plan view of the bottle opener of FIG. 1.

As shown in FIG. 2, each member 18 is held in its normal position by a means for providing a spring force 30. In the particular embodiment, the means for providing a spring force 30 is a spring commonly known in the art and need not be described in detail herein. One end of the spring 30 abuts the abutting face 19 of the member 18 within the chamber 20 and holds the member 18 in the normal position via the spring's spring force. The other end of the spring abuts either the back inner wall 21 of the chamber 20 or another abutting face 19 of a second member 18 for an adjacent aperture 14. For example, if the aperture 14*a* is located on an end of the opener 10 then one end of a first spring 30*a* abuts the abutting face 19 of a first member 18*a* and the opposite end abuts the back inner wall 21 of the chamber 20. The second spring 30*b* includes one end that abuts an abutting face 19 of a second member 18*b* and an opposite end of second spring 30*b* that abuts an abutting face 19 of a first member 18*c* positioned along a second aperture 14*b*. The body 12 may include a channel 22 disposed within it, running between two chambers 20. The second spring 30*b* may be contained within the channel 22. If the aperture 14 is positioned between 2 apertures versus being on an end of the opener 10, then 2 second springs 30*b* abut the 2 members positioned along the aperture 14.

As described above, the spring force of spring 30 holds the members 18 in their normal position; however, if a force greater than the spring force is applied to the engaging faces 17 of the members 18 in the opposite direction from the spring force, the members 18 will slide outwardly from the normal position. Once the force is removed from the members 18, the spring 30 will force the members 18 back to the normal position, i.e., inwardly toward the center of the aperture.

Figure 3:
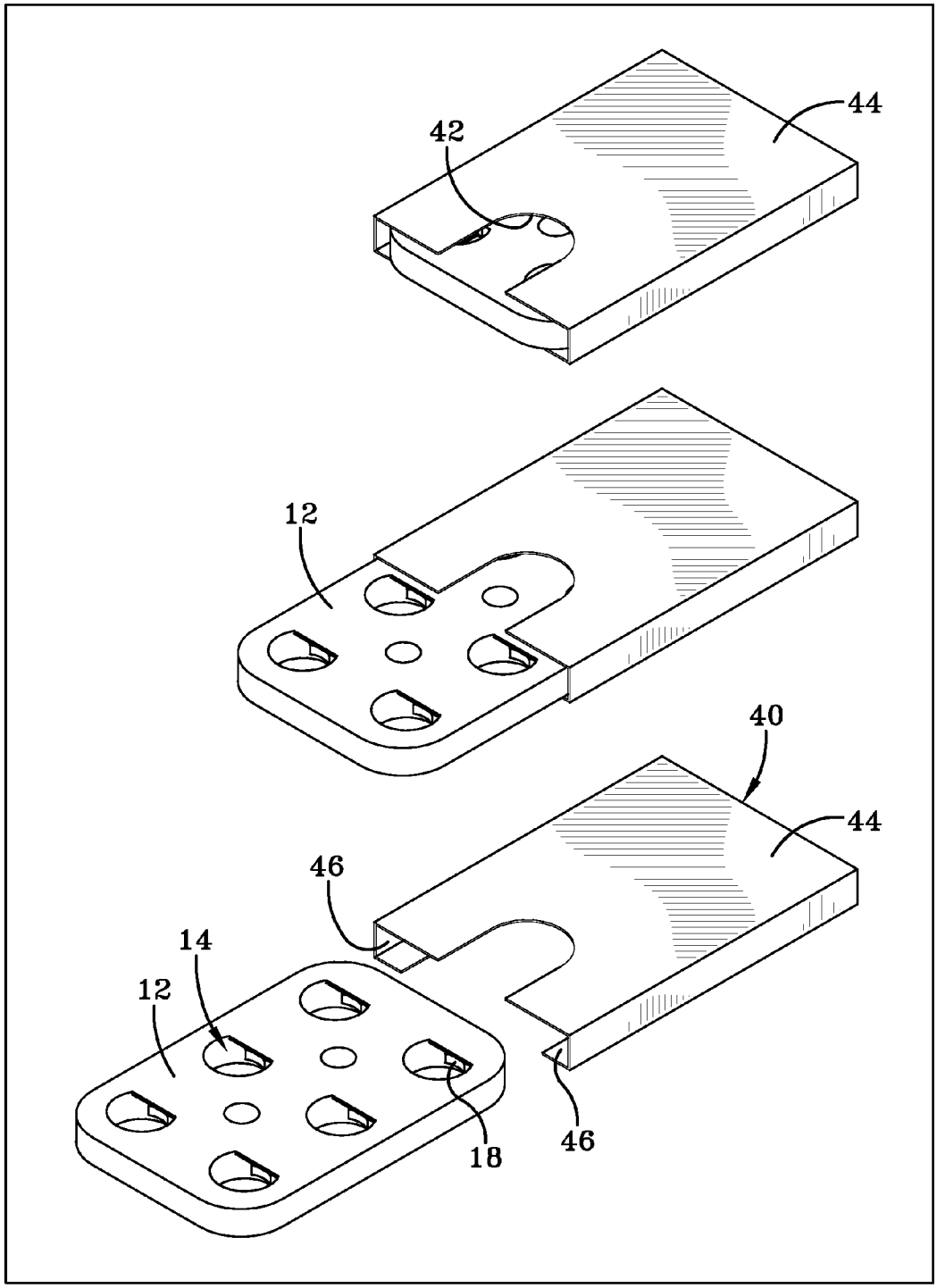
FIG. 3 illustrates a perspective view of a bottle opener and shelf of the present invention.

In an alternative embodiment, the bottle opener 10 may also detachably connect to a means for holding the opener 40 as shown in FIG. 3. The means for holding 40 may optionally include a slot 42 cut out of its body to allow one to grab the body 12 of the opener 10 to remove the opener from the means for holding 40. In an exemplary embodiment, the means for holding 40 includes a body 44 that is shaped such that 2 ends are formed into j-shaped slots 46 for receiving opener 10. The opener 10 slides between the 2 j-shaped slots, which holds the opener and optionally any bottles that are held suspended by the caps engaged by the members 18. This will be explained more fully below.

It is understood that shelf 40 could connect to opener 10 in a variety of ways, including but not limited to magnetic means, clips, fasteners, snap-fit, and any other method of connection, preferably detachable connections. The means for holding the opener 40 may be placed in, incorporated into, or retrofitted into a refrigeration unit, such as a cooler, so that the bottled beverages may be kept cool until they are served. For example, multiple means for holding opener 40 may be placed in a refrigeration unit as shelves to hold multiple openers 10 that are holding multiple bottled beverages.

Figure 4:
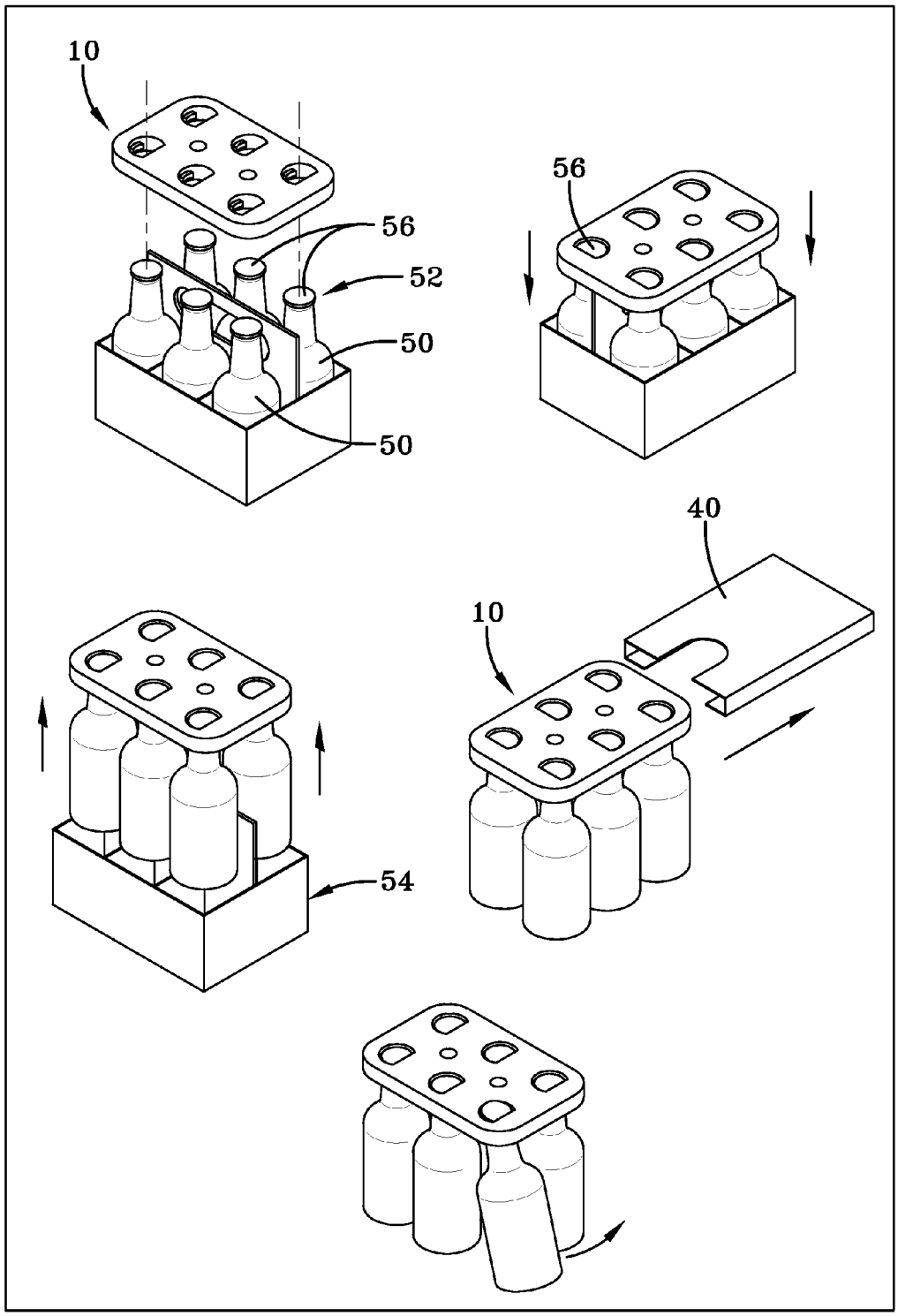
FIG. 4 illustrates a perspective view of the bottle opener and shelf of FIG. 3.

In operation, the cap end of one or more bottles is inserted into the aperture 14 of the opener 10. As shown in FIG. 4, the bottle opener 10 is placed over a package of bottle beverages, in this case a "6-pack". The bottle opener 10 is pushed down until the cap ends 52 of the bottles 50 insert into the respective apertures 14. As the caps 56 insert into the apertures 14, the cap pushes the members 18 outwardly away from the normal position and against the spring 30. This movement of the members 18 allows the caps to pass into the apertures 14. Once the members 18 clear the bottom edge of the cap, the members 18 spring back inwardly until the engaging faces 17 contact or engage the bottles or reach the normal position and stops. The stop 16 prevents the cap end 52 of the bottle 50 to push completely through the aperture 14.

The opener 10 is then lifted up, pulling the bottles out of the packaging 54. The opener 10 holds the bottles via the members 18 engaging the caps. The opener with its bottles are then inserted into the means for holding 40, wherein the bottles are suspended from their caps via the members 18 engaging the bottom of the caps. The bottles stay connected to the opener and shelf until they are served.

At which point, the server pulls the bottom portion of the bottle away from the opener 10. When pulled away from the opener 10, the member 18 and the stop 16 pry the cap 56 off the bottle with a very simple and easy motion. This design allows the server to open multiple bottles simultaneously. The apparatus of the present invention may open a variety of bottle caps, including but not limited to crown twist-off, pull-off, and a variety of caps for bottled beverages. This is a significant improvement over the prior art where generally only one cap could be remove at a time. In addition, the present invention enables the stocking of multiple bottled beverages at a time in a very efficient, simple, and economical way.

Having shown and described a preferred embodiment of the invention, those skilled in the art will realize that many variations and modifications may be made to affect the described invention and still be within the scope of the claimed invention. Thus, many of the elements indicated above may be altered or replaced by different elements which will provide the same result and fall within the spirit of the claimed invention. It is the intention, therefore, to limit the invention only as indicated by the scope of the claims.

What is claimed is:

1. A bottle opener for removing a cap off a bottle, said bottle opener comprising:

a body;

at least one aperture disposed within said body, said at least one aperture having a perimeter edge and adapted to receive the cap and an upper end of the bottle; and a member movably affixed to said body, said member having a normal position such that said member partially protrudes inside said perimeter edge of said aperture such that said member reduces the size of said aperture;

wherein said member is adapted to move outwardly from said normal position when the cap and upper end of the bottle are inserted into said aperture and move inwardly back to said normal position thereby engaging the bottle under the cap.

2. The bottle opener of claim 1, further comprising:

a means for providing a spring force, said means for providing a spring force abuts against a first side of said member to maintain said member in said normal position;

wherein the cap inserted into said aperture forces said member outwardly from the normal position against said means for providing a spring force and when said member passes a bottom edge of the cap said means for providing a spring force moves said member inwardly toward the normal position.

3. The bottle opener of claim 1, further comprising a stop located on a top surface of said body, wherein said stop prevents the cap and upper end of the bottle from pushing completely through said aperture.

4. The bottle opener of claim 1, further comprising two of said members positioned substantially opposite from one another along said aperture and two of said means for providing a spring force abutting said first sides of said members.

5. The bottle opener of claim 1, further comprising a chamber disposed within said body, wherein said member is partially disposed with said chamber.

6. The bottle opener of claim 5, further comprising a channel disposed within said body and connected to said chamber, wherein said means for providing a spring force is disposed within said channel.

7. The bottle opener of claim 1, wherein said means for providing a spring force is a spring.

8. The bottle opener of claim 1, further comprising a means for gripping a bottle opener.

9. The bottle opener of claim 1, wherein said bottle holder detachably connects to a means for holding a bottle opener, said means for holding a bottle opener adapted to hold said bottle opener while said bottle opener holds the bottle from said aperture.

10. The bottle opener of claim 9, wherein said bottle opener connected to said means for holding a bottle opener is holding a bottled beverage.

11. The bottle opener of claim 9, wherein said means for holding a bottle opener is adapted to be placed in a refrigeration unit while said bottle opener is connected to said means for holding the bottle opener and holding a bottled beverage.

12. A bottle opener for removing a cap off a bottle, said bottle opener comprising:

a body;

a plurality of apertures disposed within said body, each of said plurality of apertures having a perimeter edge and adapted to receive the cap and an upper end of the bottle;

a plurality of first members movably affixed to said body, said plurality of first members;

a plurality of second members movably affixed to said body, said plurality of second members disposed on a substantially opposite side of said plurality of apertures from said plurality of first members;

a plurality of means for providing a spring force against said plurality of first and second members, said plurality of means for providing a spring force abut a first side of said plurality of first and second members to maintain said plurality of first and second members in said normal position;

wherein said plurality of first and second members having a normal position such that said plurality of first and second members each partially protrude inside said perimeter edges of said plurality of apertures reducing the size of said plurality of apertures, said plurality of first and second members are adapted to slide outwardly from said normal position against said means for providing a spring force and spring inwardly back to said normal position.

13. The bottle opener of claim 12, further comprising a plurality of stops located on a top surface of said body, wherein said plurality of stops prevent the cap and the upper end of the bottle from pushing completely through said plurality of apertures.

14. The bottle opener of claim 12, further comprising a plurality of chambers disposed within said body, wherein said plurality of members are partially disposed with said plurality of chambers.

15. The bottle opener of claim 14, further comprising a plurality of channels disposed within said body and connecting a portion of said plurality of chambers, wherein a portion of said plurality of means for providing a spring force are disposed within said plurality of channels.

16. The bottle opener of claim 12, wherein said plurality of means for providing a spring force are springs.

17. The bottle opener of claim 12, further comprising a means for gripping said bottle opener.

18. The bottle opener of claim 12, wherein said bottle opener detachably connects to a means for holding a bottle opener such that said means for holding a bottle opener holds said bottle opener and at least one bottle inserted into said plurality of said apertures.

19. A method for opening bottled beverages, said method comprising the steps of:

providing a plurality of unopened bottled beverages;

pushing a bottle opener over caps of said plurality of bottled beverages until said bottle opener affixes under the caps of said plurality of bottled beverages;

lifting said plurality of bottled beverages from the package;

pulling lower end of one of said bottled beverages away from said bottle opener until said cap of said bottled beverage is removed;

providing a shelf adapted to receive and hold said bottle opener;

connecting said bottle opener with attached said plurality of bottled beverages to said shelf;

wherein said plurality of bottled beverages are suspended from said bottle opener by the caps of said plurality of bottled beverages.

20. A method for opening bottled beverages, said method comprising the steps of:

providing a plurality of unopened bottled beverages;

pushing a bottle opener over caps of said plurality of bottled beverages until said bottle opener affixes under the caps of said plurality of bottled beverages;

lifting said plurality of bottled beverages from the package;

pulling lower end of one of said bottled beverages away from said bottle opener until said cap of said bottled beverage is removed;

wherein said bottle opener comprised of:

a body;

a plurality of apertures disposed within said body, each of said plurality of apertures having a perimeter edge and adapted to receive the cap and an upper end of the bottle;

a plurality of first members movably affixed to said body, said plurality of first members;

a plurality of second members movably affixed to said body, said plurality of second members disposed on a substantially opposite side of said plurality of apertures from said plurality of first members;

a plurality of means for providing a spring force against said plurality of first and second members, said plurality of means for providing a spring force abut a first side of said plurality of first and second members to maintain said plurality of first and second members in said normal position;

wherein said plurality of first and second members having a normal position such that said plurality of first and second members each partially protrude inside said perimeter edges of said plurality of apertures reducing the size of said plurality of apertures, said plurality of first and second members are adapted to slide outwardly from said normal position against said means for providing a spring force and spring inwardly back to said normal position.

* * * * *